US006894652B2

(12) United States Patent
Rawnick et al.

(10) Patent No.: US 6,894,652 B2
(45) Date of Patent: May 17, 2005

(54) DIELECTRIC LENS WITH CHANGEABLE FOCAL LENGTH USING FLUIDIC DIELECTRICS

(75) Inventors: James J. Rawnick, Palm Bay, FL (US); Stephen B. Brown, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 10/369,436

(22) Filed: Feb. 18, 2003

(65) Prior Publication Data

US 2004/0160382 A1 Aug. 19, 2004

(51) Int. Cl.[7] ..... H01Q 15/08
(52) U.S. Cl. ..... 343/753; 343/911 R
(58) Field of Search ..... 343/753, 754, 343/909, 910, 911 R, 911 L

(56) References Cited

U.S. PATENT DOCUMENTS 4,640,280 A * 2/1987 Sterzer ..... 607/154
5,661,499 A 8/1997 Epshtein et al. ..... 343/911 R
6,356,246 B1 3/2002 Nakamura et al. ..... 343/911 R

OTHER PUBLICATIONS

U.S. Appl. No. 10/387,208, filed Mar. 11, 2003, Rawnick et al.
U.S. Appl. No. 10/330,755, filed Dec. 27, 2002, Rawnick et al.
U.S. Appl. No. 10/330,754, filed Dec. 27, 2002, Rawnick et al.
U.S. Appl. No. 10/330,456, filed Nov. 19, 2002, Rawnick et al.
U.S. Appl. No. 10/361,548, filed Feb. 10, 2003, Rawnick et al.
U.S. Appl. No. 10/387,209, filed Mar. 11, 2003, Rawnick et al.
U.S. Appl. No. 10/387,194, filed Mar. 11, 2003, Brown et al.
U.S. Appl. No. 10/438,435, filed May 15, 2003, Brown et al.
U.S. Appl. No. 10/414,696, filed Apr. 16, 2003, Brown et al.
U.S. Appl. No. 10/637,027, filed Aug. 7, 2003, Brown et al.
U.S. Appl. No. 10/414,650, filed Apr. 16, 2003, Brown et al.
U.S. Appl. No. 10/635,629, filed Aug. 6, 2003, Brown et al.
U.S. Appl. No. 10/459,067, filed Jun. 11, 2003, Brown et al.
U.S. Appl. No. 10/438,436, filed May 15, 2003, Rawnick et al.
U.S. Appl. No. 10/626,090, filed Jul. 24, 2003, Brown et al.
U.S. Appl. No. 10/635,582, filed Aug. 6, 2003, Rawnick et al.
U.S. Appl. No. 10/632,632, filed Aug. 1, 2003, Rawnick et al.
U.S. Appl. No. 10/614,149, filed Jul. 7, 2003, Brown et al.
U.S. Appl. No. 10/634,219, filed Aug. 5, 2003, Rawnick et al.
U.S. Appl. No. 10/458,859, filed Jun. 11, 2003, Rawnick et al.
U.S. Appl. No. 10/624,378, filed Jul. 22, 2003, Brown et al.
U.S. Appl. No. 10/438,433, filed May 15, 2003, Rawnick et al.
U.S. Appl. No. 10/460,947, filed Jun. 13, 2003, Rawnick et al.
U.S. Appl. No. 10/421,352, filed Apr. 23, 2003, Rawnick et al.
U.S. Appl. No. 10/409,261, filed Apr. 8, 2003, Pike.
U.S. Appl. No. 10/441,743, filed May 19, 2003, Pike.
U.S. Appl. No. 10/628,846, filed Jul. 28, 2003, Pike et al.
U.S. Appl. No. 10/300,455, filed Nov. 19, 2002, Brown et al.

* cited by examiner

*Primary Examiner*—Michael C. Wimer
(74) *Attorney, Agent, or Firm*—Sacco & Associates, PA

(57) ABSTRACT

A dielectric lens antenna (100) includes a dielectric lens unit (101) having a plurality of cavities (106) and at least one fluidic dielectric having a permittivity and a permeability. The antenna further includes at least one composition processor (104) adapted for dynamically changing a composition of the fluidic dielectric to vary at least one of among the permittivity and the permeability in any of the plurality of cavities and a controller (102) for controlling the composition processor to selectively vary at least one of the permittivity and the permeability in at least one of the plurality of cavities in response to a control signal (105).

28 Claims, 4 Drawing Sheets

DIELECTRIC LENS WITH CHANGEABLE FOCAL LENGTH USING FLUIDIC DIELECTRICS

BACKGROUND OF THE INVENTION

1. Statement of the Technical Field

The present invention relates to the field of dielectric lens antennas, and more particularly to dielectric lenses using fluidic dielectrics.

2. Description of the Related Art

Dielectric lens antennas are used as a means for controlling the directivity of radio waves. FIG. 1 is a cross section of a conventional dielectric lens antenna. This conventional dielectric lens antenna 1 comprises a dielectric lens 2, a primary radiator 3, and a dielectric member 4 having a lower dielectric constant than the dielectric lens 2, provided between the dielectric lens 2 and the primary radiator 3. The dielectric lens 2 is typically but not necessarily disk shaped with a lenticular section. The primary radiator 3 is disposed at the back focal point of the dielectric lens 2. The dielectric member 4 is typically formed in a substantially circular cone shape in which the primary radiator 3 is positioned at the apex, and the dielectric lens 2 is provided at the base, and its dielectric constant is uniform. Further, the dielectric lens 2 and the primary radiator 3 are connected through and secured to the dielectric member 4. In the dielectric lens antenna 1, the thickness of the dielectric lens 2 can be reduced, and moreover, it is unnecessary to provide a holder for holding the dielectric lens 2 at a predetermined position with respect to the primary radiator 3. (There also exist embodiments in which the intervening dielectric media 4 consists of free space and the relative positions of the primary radiator 3 and the dielectric lens 2 are maintained by external solid structures not shown, or in which the primary radiator 3 and the dielectric lens 2 abut. The proposed invention is applicable to these embodiments as well.) For reduction of the thickness of such a dielectric lens antenna, U.S. Pat. No. 6,356,246 discusses increasing the dielectric constant of a dielectric lens in order to make the dielectric lens thinner, shortening the back focal distance of the dielectric lens so that the distance between the dielectric lens and the primary radiator is reduced, or increasing the dielectric constant of a dielectric member so that the distance between the primary radiator and the dielectric lens is reduced, and so forth. However, when the dielectric constant of a dielectric lens is increased, the efficiency of the dielectric lens itself is reduced. Further, to reduce the back focal distance of the dielectric lens, it is necessary to increase the thickness of the dielectric lens, and as a whole, the thickness of the dielectric lens antenna can not be reduced. Further, this causes the problem that the efficiency deteriorates. Further, since materials with which dielectric lenses are formed have high heat shrinkage, dielectric lenses which are thick can not be injection-molded with high dimensional precision. In the methods for increasing the dielectric constant of the dielectric member, phase-shifting increases, due to the routes of radio waves between the primary radiator and the dielectric lens. Accordingly, there is the problem that the dielectric lens antenna can not operate normally. Furthermore, existing systems such as the dielectric lens system discussed in U.S. Pat. No. 6,356,246 are static. In other words, they are designed and optimized for a single frequency or application and fail to provide a broader range of applications in terms of operational frequency and size variability. Thus, a need exists for a dielectric lens that overcomes the problems discussed in U.S. Pat. No. 6,356,246 and further provides greater range of operation.

Two important characteristics of dielectric materials are permittivity (sometimes called the relative permittivity or $\epsilon_r$) and permeability (sometimes referred to as relative permeability or $\mu_r$). The relative permittivity and permeability determine the propagation velocity of a signal, which is approximately inversely proportional to $\sqrt{\mu\epsilon}$. The propagation velocity directly affects the electrical length of a transmission line and therefore the amount of delay introduced to signals that traverse the line.

Further, all dielectric structures have a property known as characteristic impedance, which expresses the relative amplitude of electric and magnetic fields in a propagating electromagnetic wave. Ignoring loss, the characteristic impedance of a transmission line, such as stripline or microstrip, is equal to $\sqrt{L_l/C_l}$ where $L_l$ is the inductance per unit length and $C_l$ is the capacitance per unit length. The values of $L_l$ and $C_l$ are generally determined by the permittivity and the permeability of the dielectric material(s) used to separate the transmission line structures as well as the physical geometry and spacing of the line structures. For unguided plane waves propagating in a dielectric medium, the characteristic impedance is $\eta_0\sqrt{\mu_r/\epsilon_r}$, where $\eta_0$ is the impedance of free space.

The purpose of a dielectric lens 2 is to control the delay of waves propagating through the lens at various points in order to control the direction of energy radiated from the dielectric lens antenna 1, or in the case of a receiving antenna, to control the directive response of the antenna. For a lens made of a given dielectric material, the profile of the lens is shaped to achieve the desired delays. The higher the dielectric constant of the lens material, the thinner it can be to achieve the desired delays. However, if the impedance of the lens material is radically different from the impedance of free space or of the material comprising the dielectric member 4, wave reflection losses at the material interfaces may be unacceptably high.

SUMMARY OF THE INVENTION

The invention concerns a dielectric lens antenna that includes at least one cavity and the presence, absence or mixture of fluidic dielectric in the cavity. A pump or a composition processor, for example, can be used to add, remove, or mix the fluidic dielectric to the cavity in response to a control signal. Manipulating the fluidic dielectric within the cavity selectively varies a propagation delay of a radiated signal through the dielectric lens antenna.

A dielectric lens antenna can include a dielectric lens unit having a plurality of cavities and at least one fluidic dielectric having a permittivity and a permeability. The antenna further includes at least one composition processor adapted for dynamically changing a composition of the fluidic dielectric to vary at least one of among the permittivity and the permeability in any of the plurality of cavities and a controller for controlling the composition processor to selectively vary at least one of the permittivity and the permeability in at least one of the plurality of cavities in response to a control signal.

In another aspect of the invention, a dielectric lens antenna comprises a dielectric lens unit having a plurality cavities, at least one fluidic dielectric having a permittivity and a permeability, and at least one fluidic pump unit, the fluidic pump unit comprising a fluidic dielectric coupled to at least one of said plurality of cavities for adding and removing said fluid dielectric to at least one of the plurality of cavities in response to a control signal. In this manner, energy shaping of a radiated signal is selectively varied by at least one of adding and removing the fluid dielectric from at least one of the plurality of cavities.

In yet another aspect of the present invention, a method for energy shaping an RF signal comprises the steps of propagating the RF signal through a dielectric lens antenna and dynamically adding and removing a fluidic dielectric to at least one cavity within the dielectric lens antenna to vary a propagation delay of said RF signal.

The fluidic dielectric can be comprised of an industrial solvent. If higher permeability is desired, the industrial solvent can have a suspension of magnetic particles contained therein. The magnetic particles can be formed of a wide variety of materials including those selected from the group consisting of ferrite, metallic salts, and organometallic particles.

DETAILED DESCRIPTION OF THE INVENTION

Figure 1:
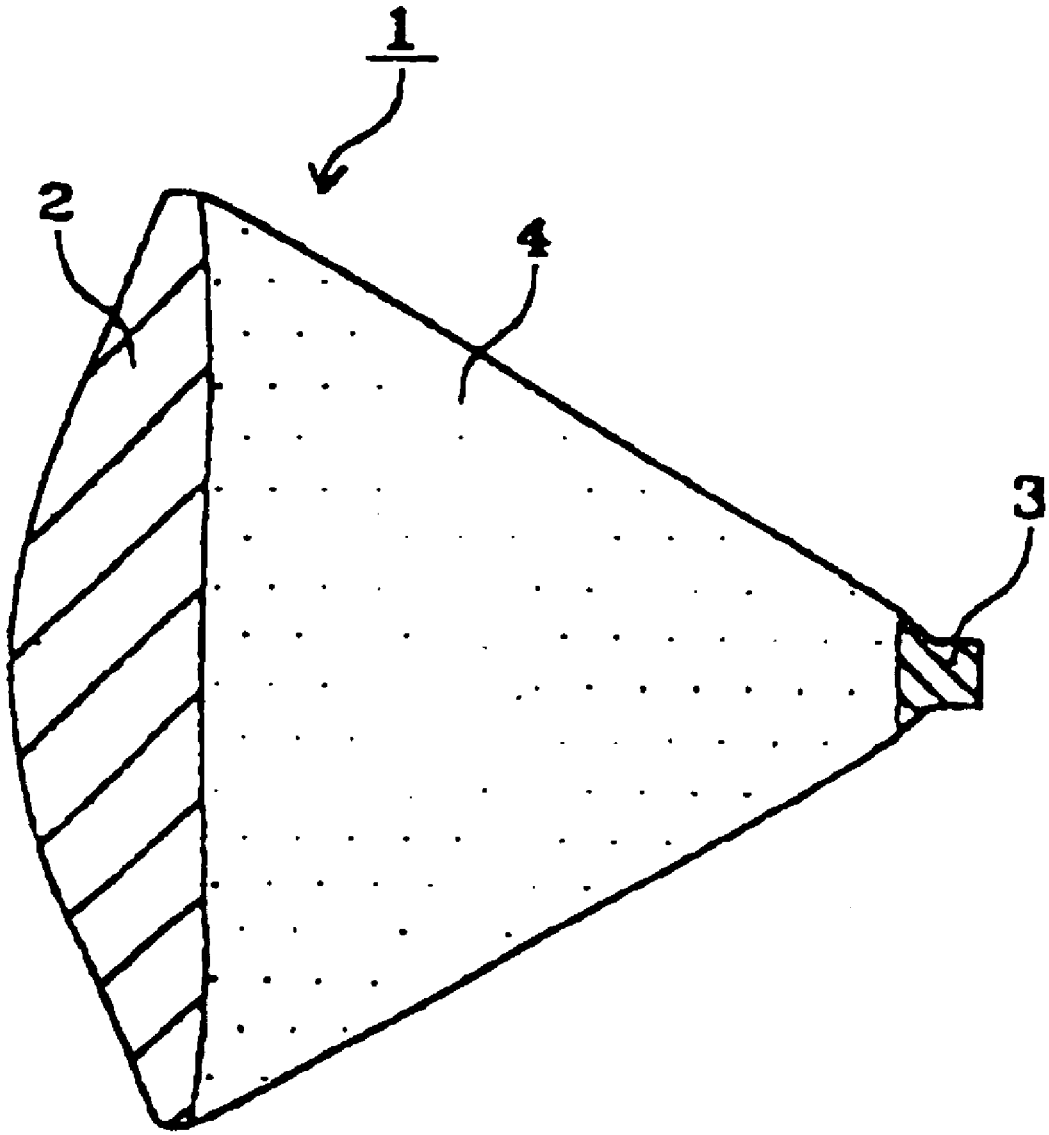
FIG. 1 (Prior Art)
FIG. 1 is a cross section of a conventional dielectric lens antenna.
Figure 2:
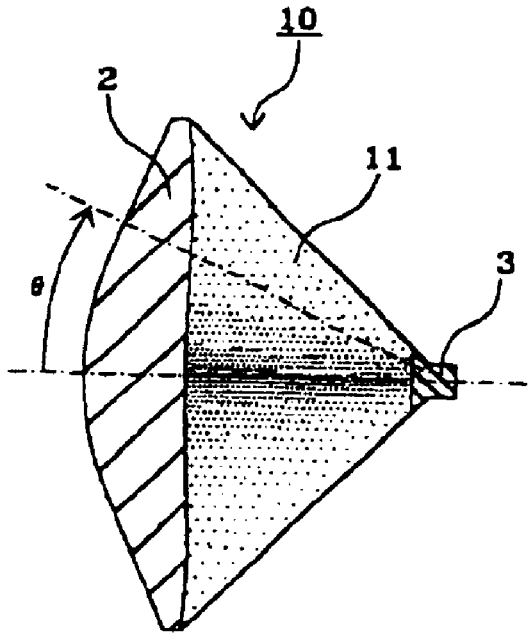
FIG. 2 (Prior Art)
FIG. 2 is a cross section of an existing dielectric lens antenna having a solid dielectric member with various static dielectric values.
Figure 3:
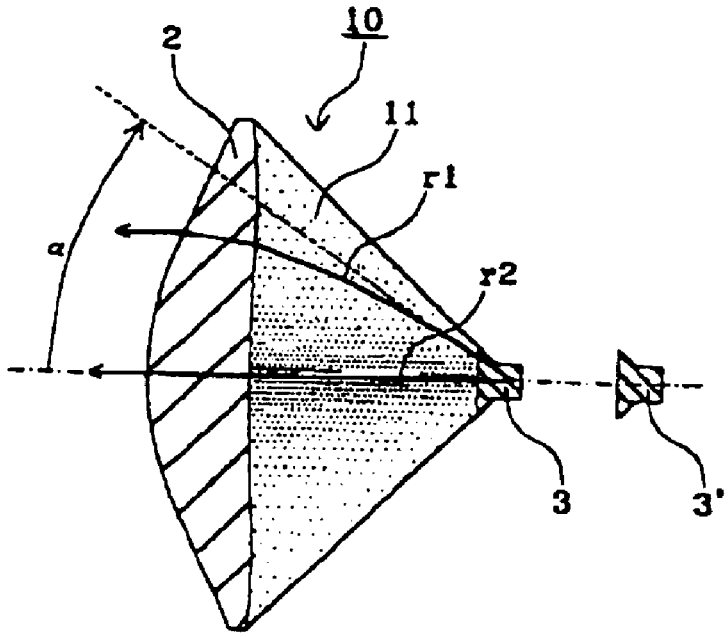
FIG. 3 (Prior Art)
FIG. 3 is a cross section showing the route of a radio wave in the dielectric lens antenna of FIG. 2.

FIG. 2 illustrates a cross section of a dielectric lens antenna according to an embodiment of U.S. Pat. No. 6,356,246. The same or equivalent parts in FIGS. 1, 2, and 3 are designated by the same reference numerals. As shown in FIG. 2, a dielectric member 11 provided between the dielectric lens 2 and the primary radiator 3 of a dielectric lens antenna 10 is formed into a substantially circular cone shape with the primary radiator 3 positioned at the apex, and the dielectric lens 2 provided at the base. The dielectric constant is unevenly distributed across the dielectric member 11 and is reduced continuously in the radial direction (the direction from the center toward the outside) of the dielectric lens 2 from the center line passing through the center of the dielectric lens 2 and the primary radiator 3, in conformity to a substantially circular cone pattern.

In this case, the change of the dielectric constant of the dielectric member 11 is determined in accordance with the following equation, for example, $$\epsilon(\theta)=[\epsilon_c+\tan^2(\theta)]\cos^2(\theta)$$

in which ($\epsilon_c$)designates the relative dielectric constant of the dielectric member 11 at the center thereof, ($\theta$) the angle, hereinafter, referred to as primary radiation angle) from the straight line as a standard, passing through the center of the dielectric lens 2 and the primary radiator 3 to the straight line passing through the primary radiator 3 and a position distant from the center of the dielectric lens 2 in the radial direction, and $\epsilon(\theta)$ is the function in which the relative dielectric constant is expressed by the primary radiation angle as a variable. That is, the relative dielectric constant $\epsilon(\theta)$ of each portion of the dielectric member 11 is automatically determined according to the equation above when the relative dielectric constant ($\epsilon_c$) of the center portion is determined as an initial value.

With respect to FIG. 3, the operation of the dielectric lens antenna 10 can be described by showing a primary radiator 3' disposed at the back focal point of the dielectric lens 2 in the case that the dielectric member 11 is absent. In general, a radio wave propagates quickly in a dielectric which has a low dielectric constant, and propagates slowly in a dielectric with a high dielectric constant. In other words, this means the presence of wavelength shortening effects which are small when the dielectric constant is low, and are great at a high dielectric constant. Further, the radio wave has the property that where high and low dielectric constants are present, the radio wave is bent toward the dielectric having the high dielectric constant. Therefore, in the dielectric lens antenna 10, the radio wave r1 radiated from the primary radiator 3 at a primary radiation angle of $\alpha$ propagates in the dielectric member 11 while being bent toward the dielectric having a high dielectric constant, namely, toward the center direction of the circular cone, to reach the back side of the dielectric lens 2. On the other hand, the radio wave r2 radiated from the primary radiator 3 at a primary radiation angle of 0° propagates rectilinearly to reach the center of the dielectric lens 2. Comparing the radio waves r1 and r2 with respect to the distance over which a radio wave radiated from the primary radiator 3 propagates to reach the back side of the dielectric lens 2, the distance for the radio wave r1 is longer than that for the radio wave r2. However, the radio wave r1 propagates in the dielectric having a lower dielectric constant than the radio wave r2, and therefore, the propagation rate is high. As a result, the radio waves r1 and r2 reach the back side of the dielectric lens antenna 2 substantially at the same time. This behavior is the same for radio waves radiated at other primary radiation angles. Accordingly, phase shifts caused by the different routes of radio waves from the primary radiator 3 to the dielectric lens 2 can be ignored. This effect can not be obtained in the case that the dielectric member has a uniform dielectric constant.

Figure 5:
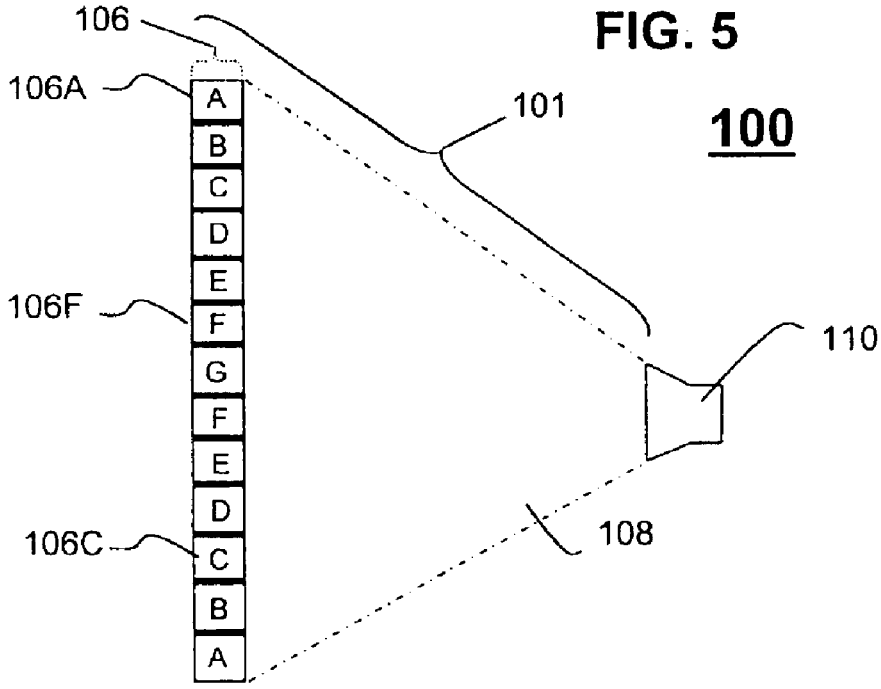
FIG. 5 is a cross section of the dielectric lens antenna of FIG. 4 in accordance with the present invention.
Figure 6:
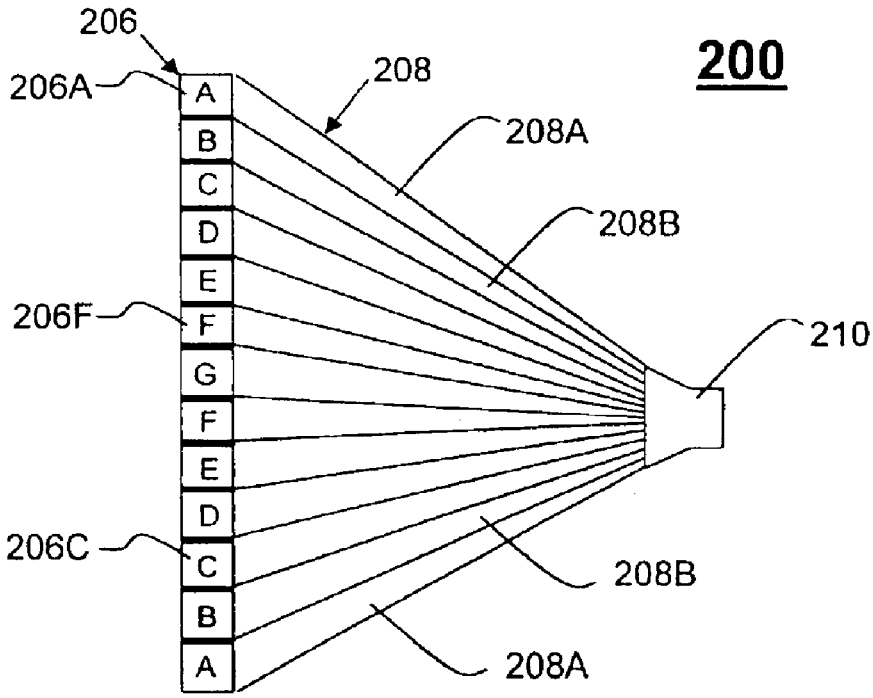
FIG. 6 is a cross section of an alternative embodiment of a dielectric lens antenna in accordance with the present invention.

Further, a radio wave radiated from the primary radiator 3 propagates while being bent toward the dielectric having a high dielectric constant, that is, toward the center direction of the circular cone. Accordingly, the radio wave can be concentrated along the center direction of the dielectric lens 2. The efficiency can be enhanced, since the leakage of radio waves into the outside of the dielectric lens 2 is reduced. Further, since the radio wave radiated from the primary radiator 3 propagates in the dielectric member 11, the number of radio waves present between the primary radiator 3 and the dielectric lens 2 is equal to that obtained when the primary radiator 3 is disposed more distant from the dielectric lens 2, namely, at the position designated by reference numeral 3' in the state that the dielectric member 11 is not provided. In other words, by providing the dielectric member 11, the distance between the primary radiator 3 and the dielectric lens 2 can be shortened (the back focal distance can be shortened). This means that the dielectric lens antenna 10 can be made thinner, but not completely flat as in the present invention as shown in FIGS. 5 and 6. Further, with the dielectric member 11, the back focal distance can be shortened. Therefore, it is unnecessary to reduce the back focal distance by thickening the lens 2 itself. To the contrary, the efficiency can be enhanced by further thinning the dielectric lens 2. Moreover, the phases of radio waves which depend on the routes of the radio waves can be controlled by adjustment of the gradient of changes in dielectric constant in the dielectric member 11. This can enhance the design flexibility for the dielectric lens antenna.

Although the dielectric lens antennas of FIGS. 2 and 3 provide greater flexibility than a conventional dielectric lens having a dielectric member with a non-varying dielectric value as shown in FIG. 1, all these antennas are primarily designed for a particular application or operating range. They all have static or fixed dielectric values. In contrast, the present invention can be coupled to a fluidic cavity as shall hereinafter be described in greater detail to provide even greater design flexibility for antenna of multiple applications and wider operating ranges.

Figure 4:
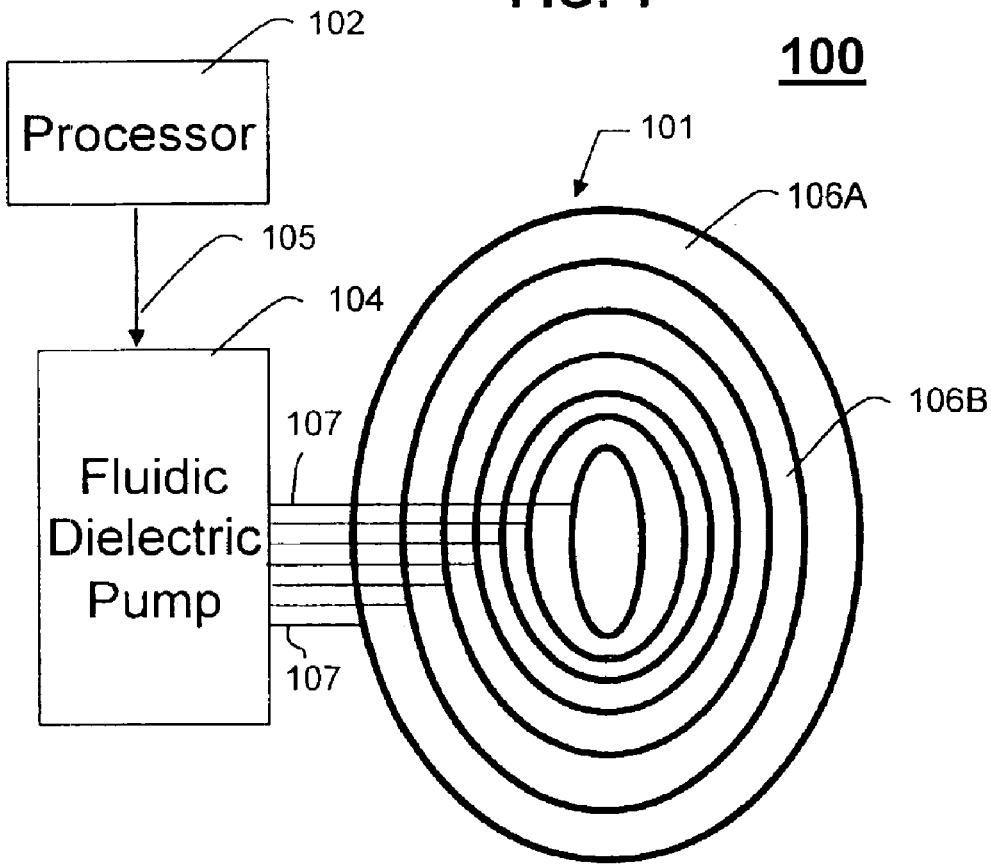
FIG. 4 is a schematic block diagram of a dielectric lens antenna in accordance with the present invention.
Figure 7:
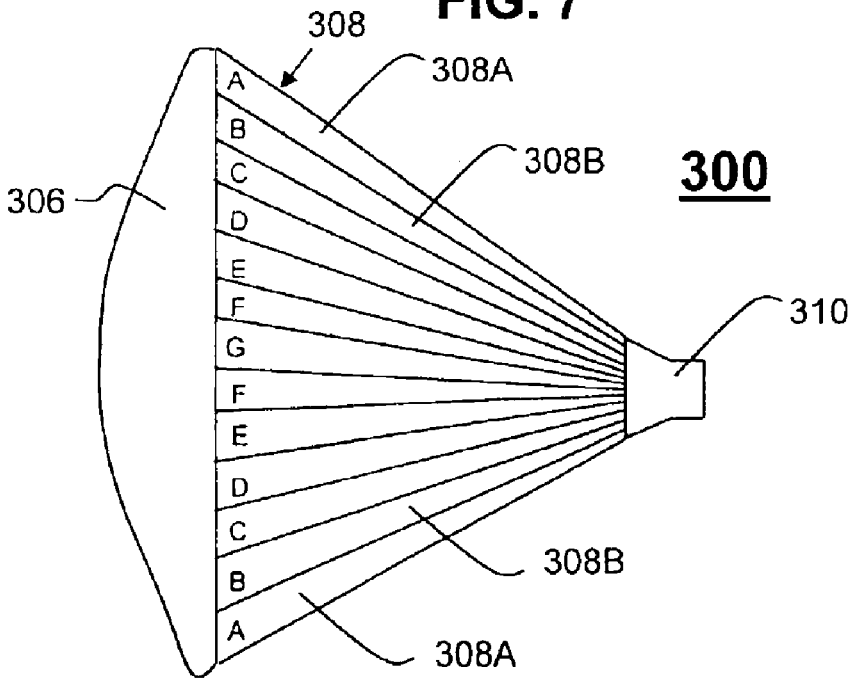
FIG. 7 a cross section of yet another alternative embodiment of a dielectric lens antenna in accordance with the present invention.

Referring to FIG. 4, a schematic diagram of a dielectric lens antenna 100 is shown having a dielectric lens unit 101 having a plurality of cavities 106 that can contain at least one fluidic dielectric having a permittivity and a permeability. The dielectric lens antenna 100 can further include at least one composition processor or pump 104 adapted for dynamically changing a composition of the fluidic dielectric to vary at least the permittivity and/or permeability in any of the plurality of cavities 106. It should be understood that the at least one composition processor can be independently operable for adding and removing the fluidic dielectric from each of said plurality of cavities. The fluidic dielectric can be moved in and out of the respective cavities using feed lines 107 for example. The dielectric lens antenna 100 can further include a controller or processor 102 for controlling the composition processor 104 to selectively vary at least one of the permittivity and/or the permeability in at least one of the plurality of cavities in response to a control signal. Preferably, the dielectric lens unit 101 comprises a dielectric lens 106 having a plurality of concentric tubes and spaced apart from a radiator 110. The concentric tube can be ideally be quartz capillary tubes, although the invention is not limited thereto. Alternatively, the dielectric lens unit 101 can include a dielectric member 108 such as a solid dielectric substrate provided between the dielectric lens 106 and the radiator 110. In yet another alternative as shown in FIG. 6, the dielectric lens unit 200 can comprise a dielectric member 208 having a plurality of concentric conical cavities or tubes (208A–G) provided between a dielectric lens 206 having a plurality of concentric cavities (206A–G) and a radiator 210. In still yet another alternative as shown in FIG. 7, the dielectric lens unit 300 can comprise a dielectric member 308 having a plurality of concentric conical cavities or tubes (308A–G) provided between a dielectric lens 306 and a radiator 210. The dielectric lens in this instance can be a solid dielectric substrate. As previously described, the fluidic dielectric can be comprised of an industrial solvent that has a suspension of magnetic particles contained therein. The magnetic particles are preferably formed of a material selected from the group consisting of ferrite, metallic salts, and organo-metallic particles although the invention is not limited to such compositions.

Referring again to FIG. 4, the controller or processor 102 is preferably provided for controlling operation of the dielectric lens antenna 100 in response to a control signal. The controller 102 can be in the form of a microprocessor with associated memory, a general purpose computer, or could be implemented as a simple look-up table.

For the purpose of introducing time delay or energy shaping in accordance with the present invention, the exact size, location and geometry of the cavity structure as well as the permittivity and permeability characteristics of the fluidic dielectric can play an important role. The processor and pump or flow control device (102 and 104) can be any suitable arrangement of valves and/or pumps as may be necessary to independently adjust the relative amount of fluidic dielectric contained in the cavities 106. Even a MEMS type pump device (not shown) can be interposed between the cavity and a reservoir for this purpose. However, those skilled in the art will readily appreciate that the invention is not so limited as MEMS type valves and/or larger scale pump and valve devices can also be used as would be recognized by those skilled in the art.

The flow control device can ideally cause the fluidic dielectric to completely or partially fill any or all of the cavities 106 (or cavities 206 and 208 in FIG. 6 or cavities 308 in FIG. 7). The flow control device can also cause the fluidic dielectric to be evacuated from the cavity into a reservoir (not shown). According to a preferred embodiment, each flow control device is preferably independently operable by controller 102 so that fluidic dielectric can be added or removed from selected ones of cavities 106 to produce the required amount of delay indicated by a control signal 105.

Propagation delay of signals in the dielectric lens antenna can be controlled by selectively controlling the presence and removal or mixture of fluidic dielectric from the cavities 106. Since the propagation velocity of a signal is approximately inversely proportional to $\sqrt{\mu\epsilon}$, the different permittivity and/or permeability of the fluidic dielectric as compared to an empty cavity (or a cavity having a different mixture with different dielectric properties) will cause the propagation velocity (and therefore the amount of delay introduced)) to be different.

According to yet another embodiment of the invention, different ones of the cavities 106 can have different types of fluidic dielectric contained therein so as to produce different amounts of delay for RF signals traversing the dielectric lens antenna 100. For example, larger amounts of delay can be introduced by using fluidic dielectrics with proportionately higher values of permittivity and permeability. Using this technique, coarse and fine adjustments can be effected in the total amount of delay introduced or in the desired energy shaping of the radiated signal.

As previously noted, the invention is not limited to any particular type of structure. As shown in the embodiments of FIGS. 5–7, the dielectric lens unit can comprise for example, (1) a dielectric lens 106 with fluidic dielectric fillable cavities 106A–G; (2) a dielectric lens 106 with fluidic dielectric fillable cavities 106A–G and a dielectric member 108; (3) a dielectric lens 206 with fluidic dielectric fillable cavities 106A–G and a dielectric member 208 having fluidic dielectric fillable cavities 208A–G; or (4) a solid dielectric lens 306 and a dielectric member 308 having fluidic dielectric fillable cavities 308A–G. The cavities do not necessarily need to be tubes or cones or in concentric arrangements as shown, but can be formed in various arrangements to accomplish the objectives of the present invention.

Composition of the Fluidic Dielectric

The fluidic dielectric can be comprised of any fluid composition having the required characteristics of permittivity and permeability as may be necessary for achieving a selected range of delay. Those skilled in the art will recognize that one or more component parts can be mixed together to produce a desired permeability and permittivity required for a particular time delay or radiated energy shape. In this regard, it will be readily appreciated that fluid miscibility can be a key consideration to ensure proper mixing of the component parts of the fluidic dielectric.

The fluidic dielectric also preferably has a relatively low loss tangent to minimize the amount of RF energy lost in the antenna. Aside from the foregoing constraints, there are relatively few limits on the range of materials that can be used to form the fluidic dielectric. Accordingly, those skilled in the art will recognize that the examples of suitable fluidic dielectrics as shall be disclosed herein are merely by way of example and are not intended to limit in any way the scope of the invention. Also, while component materials can be mixed in order to produce the fluidic dielectric as described herein, it should be noted that the invention is not so limited. Instead, the composition of the fluidic dielectric could be formed in other ways. All such techniques will be understood to be included within the scope of the invention.

Those skilled in the art will recognize that a nominal value of permittivity ($\epsilon_r$) for fluids is approximately 2.0. However, the fluidic dielectric used herein can include fluids with higher values of permittivity. For example, the fluidic dielectric material could be selected to have a permittivity values of between 2.0 and about 58, depending upon the amount of delay or energy shape required.

Similarly, the fluidic dielectric can have a wide range of permeability values. High levels of magnetic permeability are commonly observed in magnetic metals such as Fe and Co. For example, solid alloys of these materials can exhibit levels of $\mu_r$ in excess of one thousand. By comparison, the permeability of fluids is nominally about 1.0 and they generally do not exhibit high levels of permeability. However, high permeability can be achieved in a fluid by introducing metal particles/elements to the fluid. For example typical magnetic fluids comprise suspensions of ferro-magnetic particles in a conventional industrial solvent such as water, toluene, mineral oil, silicone, and so on. Other types of magnetic particles include metallic salts, organometallic compounds, and other derivatives, although Fe and Co particles are most common. The size of the magnetic particles found in such systems is known to vary to some extent. However, particles sizes in the range of 1 nm to 20 $\mu$m are common. The composition of particles can be selected as necessary to achieve the required permeability in the final fluidic dielectric. Magnetic fluid compositions are typically between about 50% to 90% particles by weight. Increasing the number of particles will generally increase the permeability.

Example of materials that could be used to produce fluidic dielectric materials as described herein would include oil (low permittivity, low permeability), a solvent (high permittivity, low permeability) and a magnetic fluid, such as combination of a solvent and a ferrite (high permittivity and high permeability). A hydrocarbon dielectric oil such as Vacuum Pump Oil MSDS-12602 could be used to realize a low permittivity, low permeability fluid, low electrical loss fluid. A low permittivity, high permeability fluid may be realized by mixing same hydrocarbon fluid with magnetic particles such as magnetite manufactured by FerroTec Corporation of Nashua, N.H., or iron-nickel metal powders manufactured by Lord Corporation of Cary, N.C. for use in ferro-fluids and magnetoresrictive (MR) fluids. Additional ingredients such as surfactants may be included to promote uniform dispersion of the particle. Fluids containing electrically conductive magnetic particles require a mix ratio low enough to ensure that no electrical path can be created in the mixture. Solvents such as formamide inherently posses a relatively high permittivity. Similar techniques could be used to produce fluidic dielectrics with higher permittivity. For example, fluid permittivity could be increased by adding high permittivity powders such as barium titanate manufactured by Ferro Corporation of Cleveland, Ohio.

The dielectric lens antennas of FIGS. 4–7 also reveal a method for energy shaping an RF signal comprising the steps of propagating the RF signal through a dielectric lens antenna and dynamically adding and removing a fluidic dielectric to at least one cavity within the dielectric lens antenna to vary a propagation delay of the RF signal. The method could also include the step of selectively adding and removing a fluidic dielectric from selected ones of a plurality of said cavities of the dielectric lens antenna in response to a control signal. The method could also include the step of selecting a permeability and a permittivity for said fluidic dielectric for maintaining a constant characteristic impedance along an entire length of at least one cavity. It should also be noted that the step of step of dynamically adding and removing a fluidic dielectric can comprise the step of mixing fluidic dielectric to obtain a desired permeability and permittivity. According to a preferred embodiment, each cavity can be either made full or empty of fluidic dielectric in order to implement the required time delay or energy shape. However, the invention is not so limited and it is also possible to only partially fill or partially drain the fluidic dielectric from one or more of the cavities.

In either case, once the controller has determined the updated configuration for each of the cavities necessary to implement the time delay, the controller can operate device 104 to implement the required delay. The required configuration can be determined by one of several means. One method would be to calculate the total time delay for each cavity or for all the cavities at once. Given the permittivity and permeability of the fluid dielectrics in the cavities, and any surrounding solid dielectric (108 in FIG. 5 or 306 in FIG. 7 for example), the propagation velocity could be calculated for the dielectric lens unit. These values could be calculated each time a new delay time request is received or could be stored in a memory associated with controller or processor 102.

As an alternative to calculating the required configuration of the fluidic delay units, the controller 102 could also make use of a look-up-table (LUT). The LUT can contain cross-reference information for determining control data for fluidic delay units necessary to achieve various different delay times and energy shapes. For example, a calibration process could be used to identify the specific digital control signal values communicated from controller 102 to the cavities that are necessary to achieve a specific delay value or energy shape. These digital control signal values could then be stored in the LUT. Thereafter, when control signal 105 is updated to a new requested delay time, the controller 102 can immediately obtain the corresponding digital control signal for producing the required delay.

As an alternative, or in addition to the foregoing methods, the controller 102 could make use of an empirical approach that injects a signal at an RF input port and measures the delay to an RF output port. Specifically, the controller 102 could check to see whether the appropriate time delay or energy shape had been achieved. A feedback loop could then be employed to control the flow control devices (104) to produce the desired delay characteristic.

Those skilled in the art will recognize that a wide variety of alternatives could be used to adjust the presence or absence or mixture of the fluid dielectric contained in each of the cavities. Additionally, those skilled in the art should also recognize that a wide variety of configurations in terms of cavities could also be used with the present invention. Accordingly, the specific implementations described herein are intended to be merely examples and should not be construed as limiting the invention.

We claim:

1. A dielectric lens antenna, comprising:

a dielectric lens unit having a plurality of cavities;

at least one fluidic dielectric having a permittivity and a permeability;

at least one composition processor adapted for dynamically changing a composition of said fluidic dielectric to vary at least one of said permittivity and said permeability in any of the plurality of cavities; and a controller for controlling said composition processor to selectively vary at least one of said permittivity and said permeability in at least one of said plurality of cavities in response to a control signal.

2. The dielectric lens antenna of claim 1, wherein the dielectric lens unit comprises a dielectric lens having a plurality of concentric tubes and spaced apart from a radiator.

3. The dielectric lens antenna of claim 1, wherein the dielectric lens unit comprises a dielectric lens having a plurality of concentric tubes and a dielectric member provided between the dielectric lens and a radiator.

4. The dielectric lens antenna of claim 1, wherein the dielectric lens unit comprises a dielectric member having a plurality of concentric tubes provided between a dielectric lens and a radiator.

5. The dielectric lens antenna of claim 1, wherein the dielectric lens unit comprises a dielectric lens and a dielectric member having a plurality of concentric tubes and wherein the dielectric member is provided between the dielectric lens and a radiator.

6. The dielectric lens antenna of claim 3, wherein the dielectric member is a solid dielectric substrate.

7. The dielectric lens antenna of claim 4, wherein the dielectric lens is a solid dielectric substrate.

8. The dielectric lens antenna of claim 1, wherein the plurality of cavities comprises a plurality of concentric tubes comprised of quartz capillary tubes.

9. The dielectric lens antenna of claim 1, wherein each of said at least one composition processor is independently operable for adding and removing said fluidic dielectric from each of said plurality of cavities.

10. The dielectric lens antenna according to claim 1, wherein said fluidic dielectric is comprised of an industrial solvent.

11. The dielectric lens antenna according to claim 10, wherein said fluidic dielectric is comprised of an industrial solvent that has a suspension of magnetic particles contained therein.

12. The dielectric lens antenna according to claim 11, wherein said magnetic particles are formed of a material selected from the group consisting of ferrite, metallic salts, and organo-metallic particles.

13. A dielectric lens antenna, comprising:

a dielectric lens unit having a plurality cavities;

at least one fluidic dielectric having a permittivity and a permeability;

at least one fluidic pump unit, said fluidic pump unit comprising a fluidic dielectric coupled to at least one of said plurality of cavities for adding and removing said fluid dielectric to said at least one of said plurality of cavities in response to a control signal.

wherein energy shaping of a radiated signal is selectively varied by at least one of adding and removing said fluid dielectric from at least one of the plurality of cavities.

14. The dielectric lens antenna of claim 13, wherein the dielectric lens unit comprises a dielectric lens having a plurality of concentric tubes and spaced apart from a radiator.

15. The dielectric lens antenna of claim 14, wherein the dielectric lens unit comprises a dielectric lens having a plurality of concentric tubes and a dielectric member provided between the dielectric lens and a radiator.

16. The dielectric lens antenna of claim 14, wherein the dielectric lens unit comprises a dielectric member having a plurality of concentric tubes provided between a dielectric lens and a radiator.

17. The dielectric lens antenna of claim 14, wherein the dielectric lens unit comprises a dielectric lens and a dielectric member having a plurality of concentric tubes and wherein the dielectric member is provided between the dielectric lens and a radiator.

18. The dielectric lens antenna of claim 15, wherein the dielectric member is a solid dielectric substrate.

19. The dielectric lens antenna of claim 16, wherein the dielectric lens is a solid dielectric substrate.

20. The dielectric lens antenna of claim 13, wherein the plurality of cavities comprises a plurality of concentric tubes comprised of quartz capillary tubes.

21. The dielectric lens antenna of claim 13, wherein each of said at least one fluid pump unit is independently operable for adding and removing said fluidic dielectric from each of said plurality of cavities.

22. The dielectric lens antenna according to claim 13, wherein said fluidic dielectric is comprised of an industrial solvent.

23. The dielectric lens antenna according to claim 22, wherein said fluidic dielectric is comprised of an industrial solvent that has a suspension of magnetic particles contained therein.

24. The dielectric lens antenna according to claim 23, wherein said magnetic particles are formed of a material selected from the group consisting of ferrite, metallic salts, and organo-metallic particles.

25. A method for energy shaping an RF signal, comprising the steps of:

propagating the RF signal through a dielectric lens antenna;

dynamically adding and removing a fluidic dielectric to at least one of a plurality of cavities within the dielectric lens antenna to vary a propagation delay of said RF signal.

26. The method according to claim 25, further comprising the step of selectively adding and removing the fluidic dielectric from selected ones of said plurality of cavities of the dielectric lens antenna in response to a control signal.

27. A method for energy shaping an RF signal, comprising:

propagating the RF signal through a dielectric lens antenna;

dynamically adding and removing a fluidic dielectric to at least one cavity within the dielectric lens antenna to vary a propagation delay of said RF signal;

selecting a permeability and a permittivity for said fluidic dielectric for maintaining a constant characteristic impedance along an entire length of said at least one cavity.

28. A method for energy shaping an RF signal, comprising:

propagating the RF signal through a dielectric lens antenna;

mixing a fluidic dielectric to obtain a desired permeability and permittivity;

dynamically adding and removing the mixed fluidic dielectric to at least one cavity with in the dielectric lens antenna to vary a propagation delay of said RF signal.

* * * * *